US006295895B1

(12) United States Patent
Hejninger

(10) Patent No.: US 6,295,895 B1
(45) Date of Patent: Oct. 2, 2001

(54) HAND TOOL WITH SUPPORTING ARM AND RETAINING MECHANISM AND A METHOD FOR LOOSENING OF ATTACHMENT MEANS

(76) Inventor: Ingvar Hejninger, Norrlandsgatan 42, SE-752 29 Uppsala (SE)

( * ) Notice: Subject to any disclaimer, the term of this patent is extended or adjusted under 35 U.S.C. 154(b) by 0 days.

(21) Appl. No.: 09/423,447

(22) PCT Filed: May 18, 1998

(86) PCT No.: PCT/SE98/00931

§ 371 Date: Nov. 9, 1999

§ 102(e) Date: Nov. 9, 1999

(87) PCT Pub. No.: WO98/53958

PCT Pub. Date: Dec. 3, 1998

(30) Foreign Application Priority Data

May 26, 1997 (SE) ..... 9701962

(51) Int. Cl.[7] ..... B25B 17/00
(52) U.S. Cl. ..... 81/57.39; 81/57.31
(58) Field of Search ..... 81/57.3, 57.31, 81/57.39, 57.4

(56) References Cited

U.S. PATENT DOCUMENTS

| | | | | |
|---|---|---|---|---|
| 755,569 | | 3/1904 | Freeland . | |
| 1,418,161 | | 5/1922 | Pease . | |
| 4,507,990 | * | 4/1985 | Lack | 81/57.31 X |
| 4,546,676 | | 10/1985 | Kiefer, Jr. . | |
| 5,125,297 | * | 6/1992 | Bai et al. | 81/57.31 |
| 5,176,047 | * | 1/1993 | Bai et al. | 81/57.31 X |
| 5,953,966 | * | 9/1999 | Spirer | 81/57.39 X |

FOREIGN PATENT DOCUMENTS

| | | |
|---|---|---|
| 681606 | 4/1993 | (CH) . |
| 2941045 | 6/1981 | (DE) . |
| 84049634 | 10/1984 | (SE) . |
| 580109 | 11/1977 | (SU) . |
| 9422642 | 10/1994 | (WO) . |

* cited by examiner

*Primary Examiner*—James G. Smith
(74) *Attorney, Agent, or Firm*—Young & Thompson

(57) ABSTRACT

The hand tool includes tree main parts, a support arm, a torque application arm and a socket. The socket is intended to grip into the bolt head and mediate a torque from the axle of the hand tool. The support arm forms a holding-up against a supporting base and the torque application arm is used to apply a torque. Both the support arm and the torque application arm have latching devices with respect to the axle, which locks in the same direction and implies that a torque applied by the torque application arm is maintained by action of the latching mechanism of the support arm. Furthermore, the hand tool is preferably designed with a torque enhancement.

15 Claims, 5 Drawing Sheets

HAND TOOL WITH SUPPORTING ARM AND RETAINING MECHANISM AND A METHOD FOR LOOSENING OF ATTACHMENT MEANS

TECHNICAL FIELD

The present invention relates to a device for loosening of attachment means, such as a nut, bolt, screw or the like.

BACKGROUND OF THE INVENTION

It is a known fact in all mechanical activity that bolt, nuts etc., that are allowed to be tightened for a period of time, in particular in exposed environments, often can be very difficult to loosen. This depends on that the friction forces between the threads of the nut and the bolt have increased as a result from a number of processes. The most obvious is corrosion, but also time dependent changes of the deformations that arise at the fastening can contribute to an increased friction between the surfaces and thereby an increased resistance against loosening.

One of the most known examples of this problem appears in connection with vehicle wheels. When, for instance, after a puncture, a vehicle wheel has to be dismounted, one has to face the problem to loosen the nuts or bolts holding the wheel at the hub. By security reasons, those nuts and bolts have to be relatively firmly tightened and if they are machine-tightened by so called nutrunner, the method used by garages and rubber workshops, the nuts and bolts are often tightened very firmly. It has been shown that the simple tools normally included in the equipment of the vehicle are not capable to give the torques enabling a person with normal or less body strengths to loosen the nuts or bolts, in particular if they have been tightened for a longer period and "been settled".

In most cases, one has tried to increase the torque to loosen the nuts or bolts. A common method in connection with conventional equipment is to extend the momentum arm by a tube or the like. Despite this, it may be almost impossible for a less strong person to perform the dismounting. It is also common to make a wrench or shock to the dismounting tool to momentarily obtain a larger torque. However, these torques act for very short time periods and such working operations are very tough for the body and lead easily to injuries.

When the nut or bolt at the end loosens, this occurs very rapidly in many cases. The person, which up to this moment has acted on the tool with a large torque, now has to rapidly reduce the torque to parry such a "let go". This may be very difficult to manage and the result is often also here powerful wrenches for nuts, the tool or the person itself.

Most tools are only in contact with the nut or bolt head and this results in that many tools easily slides off the nut and bolt head, respectively, which always involves damages of the head and tool.

A method which is often used for firmly fastened nuts is to apply a torque on the bolt, whereupon the bolt is exposed to heat, gentle strokes and/or chemical solutions. These measures, together with the applied torque, generally makes even the most hard stuck nuts to loosen. This is particularly true if the torque is applied constantly. However, there are no tools intended to help to keep an applied torque, but to achieve a continues torque, this has to be applied by the user.

Another problem that often arises in connection with mounting or dismounting of nuts/bolts is that the space around the nut/bolt is very limited and that the angle strokes for the spanners are limited.

In known art, there are a number of tools which uses ratchet spanner techniques and/or torque amplifying means. However, these principles are always used in a momentarily manner during the use of the tools.

By the Swedish patent application 84.04963-4, such an aid is earlier known. This comprises a circular housing, including a gear switch, the input shaft of which projects from one side of the housing and is there connectable to a crank while its output shaft projects from the opposite side of the housing, presenting a socket gripping around the nut or bolt head. At the housing, a support tube is welded, which by an extension pivotally connected thereto can be brought into contact with the ground or floor base to create a holding-up action during the unscrewing. This tool provides certainly an amplified force by the gearing, but this effect is rather to equal with the effect which is achieved by an extended momentum arm. The torque has to be supplied at all moments. In particular in the proposed embodiment, where the operation is intended to be performed by the motion of a crank, the effect varies substantially depending on the possibilities to apply the necessary torque. Another disadvantage with the known tool is that it is heavy and bulky and has to be adapted in a special manner before it may be used.

Within the known art, there are also other tools enhancing the torque in different ways. The U.S. Pat. No. 4,546,676 discloses a torque amplifying spanner, where when a higher torque is needed, an arm may be displaced giving a higher torque by a gear action. This gives the same effect as extending the momentum arm. Also here, the torque has to be supplied at all moments. Also the German patent DE 29 41 045 discloses a number of torque amplifying hand tools for loosening of nuts. Also here, the idea of an additional handle to achieve this effect is present. This patent document, in one of its embodiments, also presents a solution, where an additional handle acts at the nut by a ratchet spanner principle, whereby this additional handle may be returned if its stroke becomes to large without influencing the nut. This does not change the fact that even in this case, the torque has to be supplied continuously.

The Swiss patent CH 681 606 discloses a double acting ratchet spanner. This ratchet spanner does not use any torque amplification and does not use any kind of holding-up principle, since both shafts are intended to be operated by hand, why the torque also here has to be supplied continuously.

DISCLOSURE OF THE INVENTION

Thus, the object of the invention has primarily been to provide a device for loosening of attachment means, such as a nut, bolt, screw or the like, which device does not present any of the above mentioned disadvantages and which makes it possible for anyone to perform loosening of nuts or bolts in a manner which is simple, fast and lenient to the body. The invention is based on a torque amplifying device which during longer periods of time can let an applied torque act on the detail to be loosened to fatigue the friction creating bondings by using a reaction force and a double acting latching mechanism.

Another object has been to achieve a device having a form and size such that it without doubt can be included in the regular tool set for e.g. a vehicle.

Furthermore, the invention provides a careful loosening of the actual detail.

For carrying through these and other objects, the invention has the characteristics set forth in the claims.

BRIEF DESCRIPTION OF THE FIGURES

At the attached drawings, the given embodiment of the invention is shown, whereby.

ILLUSTRATIVE EMBODIMENT

Figure 1:
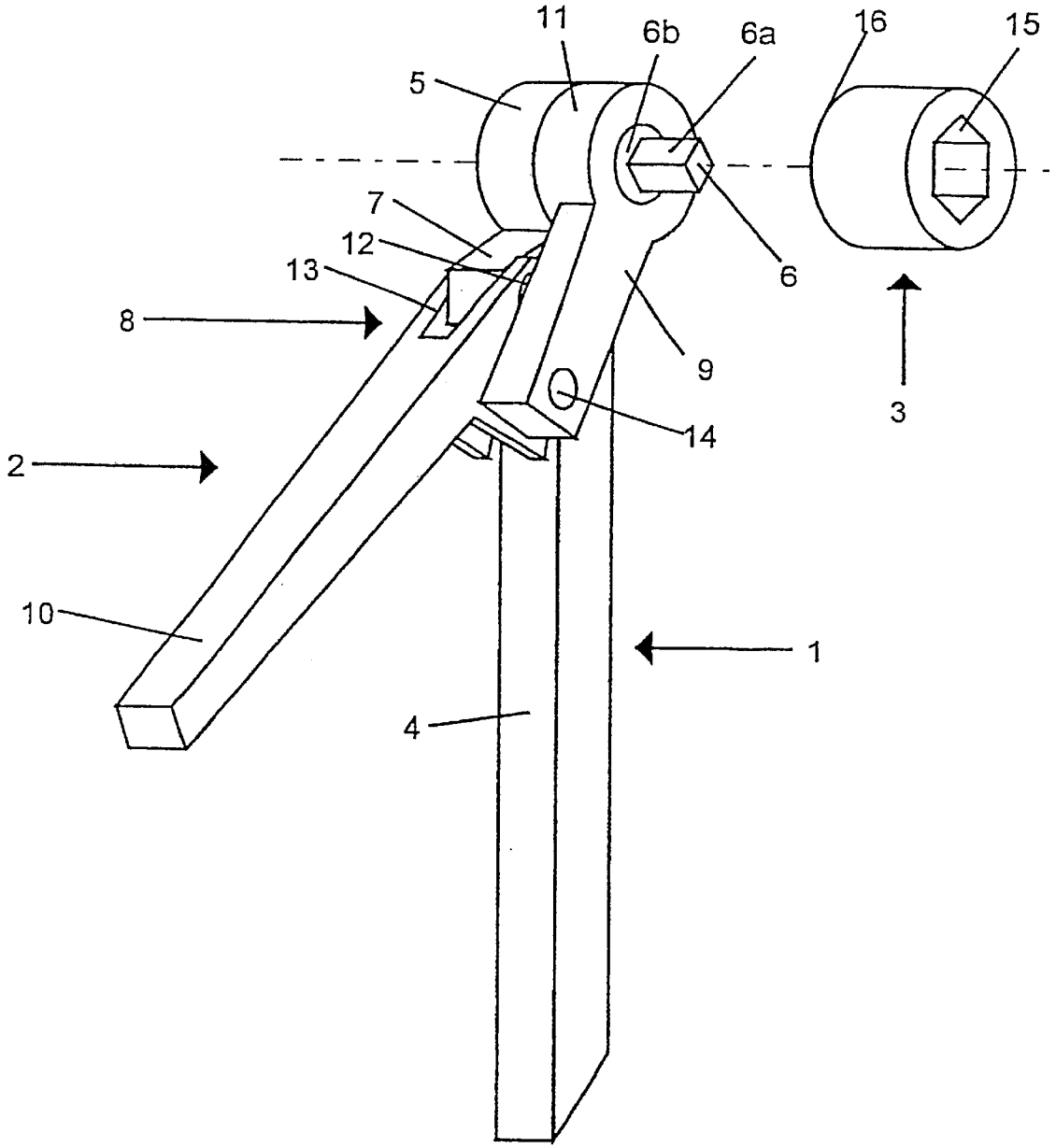
FIG. 1 shows the main parts of a tool according to the present invention, in perspective and in a separated state.

An embodiment of the tool according to the invention comprises three main parts, a support arm 1, a torque application arm 2 and a socket 3. The support arm, generally denoted by the numeral 1 comprises an elongated arm portion 4 and a support arm cap 5 arranged at one end of said arm portion. The support arm cap 5 presents a circular hole and is suitably provided with furrows inside. An axle, generally denoted by the numeral 6, is arranged through the hole of the support arm cap. The axle 6 comprises mainly two parts and is rotatably arranged with respect to the support arm cap 5, but locked against movements along the axis of the cap. A first part of a centre portion 6*b* of the axle 6 is located within the support arm cap 5, which centre portion essentially has a circular cross section, with a diameter essentially corresponding to the inner diameter of the support arm cap 5. The centre portion of the axle also comprises recessed areas, in which latching mechanisms are arranged, which are described below. One of these latching mechanisms locks the rotation between the axle 6 and the support arm cap 5 in such a way that the axle freely may rotate in one direction, but is locked in the other. This is an, as such, already known principle for ratchet spanners. At one side of the centre portion 6*b*, the axle consists of a first end portion 6*a*. This has a non-circular, preferably rectangular or hexagonal, cross section. The support arm 1 further comprises a protruding shoulder 7 adjacent to the support arm cap 5, which shoulder comprises an oval hole (not shown) in the same direction as the axle 6.

The tool according to the first embodiment of the present invention further comprises a torque application arm, generally referred to as 2, and a socket, generally referred to as 3. The torque application arm 2 comprises a torque amplifying means 8, which comprises two arms, one high torque arm 9 and a low torque arm 10, and a torque arm cap 11 arranged to one end of the high torque arm 9. The low torque arm 10 is, at the end located closest to the axle 6, formed as a fork 13, with a distance between its legs that fits at each side of the protruding shoulder 7 of the support arm 1. The low torque arm 10 is turnably arranged at the protruding shoulder 7 by means of a first turning axis 12 arranged between the legs of the fork 13, which first turning axis 12 extends through the oval hole of the shoulder 7. The high torque arm 9 is turnably arranged at the low torque arm 10 by means of a second turning axis 14 turnably gripping into a hole (not shown) formed in one of the fork legs.

The above arrangement of the low and high torque arms, respectively, together forms a torque amplifying means. A long displacement of a low torque at the low torque arm 10 is transferred to a short displacement with a high torque at the high torque arm 9. The torque amplification is mainly determined by the relation of the distances between the turning centre of the axle 6 and the second turning axis 14 and between the second turning axis 14 and the first turning axis 12, respectively.

The torque arm cap 11 is formed with a circular hole, which suitably is provided with furrows. The torque arm cap 11 is in this embodiment rotatably arranged around a second part of the centre portion 6*b* of the axle 6 of the support arm between the support arm cap 5 and the first end part 6*a*, but is locked against axial movements. It is of course also possible to arrange the support arm 1 and the torque application arm 2 in the opposite order.

The centre portion 6*b* is designed so as to contain two fundamental latching mechanisms. In the space inside the support arm cap 5, a first ratchet is disposed, which prevent rotation of the support arm 1 in one of the directions, and in the space inside the torque arm cap 11 is a second ratchet disposed, which prevents the rotation of the torque application arm 2 in the same above mentioned direction. These latches may be designed as two separate latches or be produced in one unit, under the assumption that they may act latching independently of each other.

Figure 2:
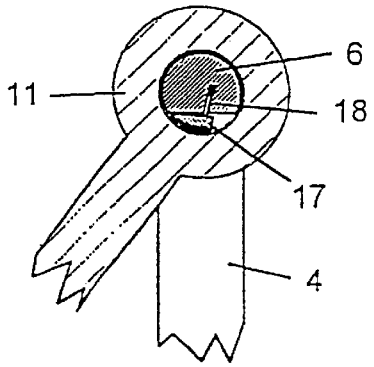
FIG. 2 shows a section of a part of the tool shown in FIG. 1, which shows an example of a latch mechanism.
Figure 3:
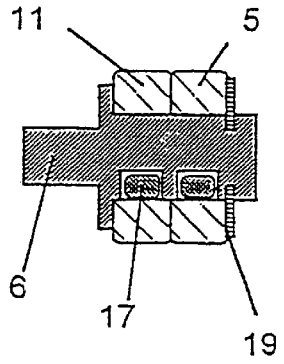
FIG. 3 shows another section of a part of the tool shown in FIG. 1.

One example on how these latches may be arranged is shown in FIGS. 2 and 3. A latching element 17 with a preferably furrowed surface is disposed in a recess in the axle 6, see FIG. 2. The latching element is gently pushed against the also furrowed inside of the torque arm cap 11 by means of a spring loaded pin 18. At a, in FIG. 2, counter clockwise movement of the torque arm cap 11, the latching element locks between the axle and the cap, whereby the axle joins in the motion. At a clockwise movement, the latching element releases the grip against the torque arm cap 11 and the cap can freely be turned without influencing the axle. The latching mechanism of the support arm has a corresponding design. FIG. 3 shows, in cross-section, both the latching mechanisms. The number 19 denotes a locking washer for mounting of the axle.

The socket 3 has a hole formed in one of its ends 16, which also presents the same cross section as the first end portion 6*a* of the axle 6. The other end of the socket 3 is inside formed 15 to receive the nut or bolt head to be loosened or fastened. The socket may be fixedly mounted at the first end portion 6*a*, but it is to prefer if the socket is removably disposed at the axle 6, to enable the changing of this part for adjustment to different sizes of nuts or bolts.

The use of the above described tool for loosening of bolts or nuts is explained in the following. To this end, the latching mechanism within the cap of the support arm is arranged to lock a movement of the arm portion 4 into the paper, as it is illustrated in FIG. 1, relative to a stationary axle, which movement is referred to as a clockwise movement of the support arm. The socket 3 is mounted at the axle 6. The socket is arranged to the nut or bolt to be loosened by bringing the nut or bolt head in engagement with the inner form 15 of the nut socket. The arm part 4 is turned clockwise around the axle 6, which is allowed by the latching mechanism, until it is brought into contact with any solid surface, against which it is allowed to hold up. In the example of nuts for vehicle wheels, this surface is suitably constituted by the ground underneath the vehicle. The torque amplification means 8 is then turned counterclockwise around the axle 6 by applying a certain torque, so as to bring the axle and the nut socket and the nut/bolt to rotate. If the nut/bolt is firmly fastened, the torque is collected as a slight elastic deformation of the torque application arm, axle, nut socket and nut/bolt, i.e. those parts act as a very stiff spring. The axle is often brought to be turned around somewhat even if the nut does not loosen and the axle is thereby rotated with respect to the support arm cap 5. The torque amplification mechanism of the tool is here used to give a high torque. When the person who is going to loosen the nut/bolt does not manage to increase or maintain the torque, the above mentioned parts start to recover elastically. This return springing is, however, locked by that the support arm 1 is supported against the support surface (for instance the ground) since the latching mechanism within the support arm cap prohibit such a relative motion between the support arm cap and axle. Thereby, a part of the torque applied to the nut/bolt is maintained also after the torque at the torque application arm has vanished. The person to loosen the nut/bolt is now allowed to recover for the next round of force application, while the remainder amount of torque slowly fatigues the enhancing mechanisms of turning friction. The torque application arm may during this phase be turned back, in the direction that the latch within the torque arm cap allows, to achieve a more suitable position for torque application.

Figure 4:
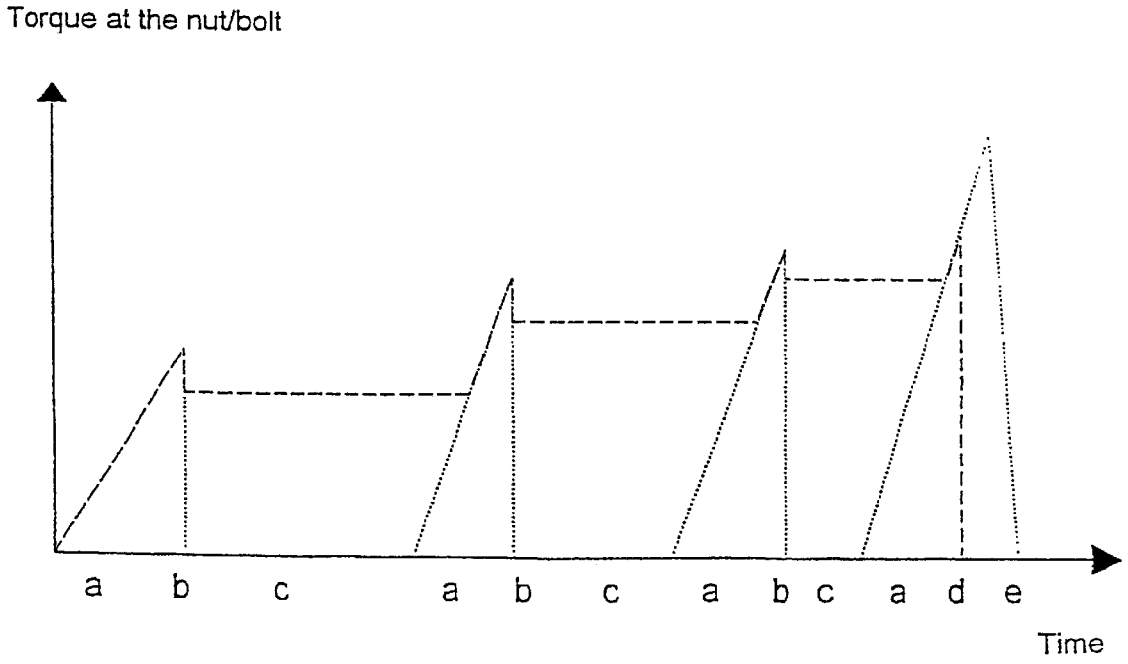
FIG. 4 shows a curve presenting the difference in operation between a conventional tool according to the state of the art and a tool according to the present invention.

FIG. 4 shows a schematic drawing of how the torque at the nut/bolt is thought to be built up, in comparison with a method according to the known art. The broken line represents a nut loosening with a tool according to the present invention, and the point line represents a course with a conventional tool. The time a denotes a torque application event, b a time when the user unloads the torque application arm and perhaps pulls it back for making a new grip, c a rest event, d the time when this tool loosens the nut/bolt and e the time when a conventional tool fulfils its labour. If the torque despite the torque amplification is not enough, the above mentioned exceptional measures of heating, knocking and/or solving may have to be used, whereby the torque acts all the time.

The maintaining of the torque by a latching and resilient action in the tool also gives advantages at the actual moment of loosening. As has been described above, firmly tightened nuts/bolts often loosen very sudden, whereby a wrench is formed in the tool by methods according to known art resulting in a risk for body injuries. This depends on that the friction between the threads in the bolt and nut suddenly drops very strongly, partly depending on that an amount of bindings by e.g. corrosion and/or deformation cease and partly depending of that the friction between two mutually moving surfaces generally are much lower than between the same surfaces when stationary. To avoid a rapid wrench with the tool, the operator has to quickly reduce the applied torque, something that is very difficult to do when one, in the moment before, with full power has tried to loosen the bolt/nut. With the above described tool, such sudden movements are avoided. When the nut/bolt with the above described tool loosens, the latching between the axle 6 and the support arm 1 cease, since the axle 6 now is allowed to move. The stored torque in these parts drops thereby very fast to zero. Thus, this contribution to the torque drops in the same moment as the friction between the threads drops, which results in that the nut/bolt loosens with a smooth and even motion.

An alternative embodiment of the tool may also be used by fastening of nuts/bolts. In this embodiment, shown in FIG. 5, the axle 6 of the support arm also comprises a second end portion 6*c* extending at the opposite side of the centre portion 6*b* as compared with the first end portion 6*a*. This end portion 6*c* is designed in the same manner as the first one and may thus be used for fastening of nuts/bolts, since the latching of the support arm then acts in the opposite direction.

These tools solve all earlier discussed problems. It has the basic principle for a torque maintaining support arm, with its properties for fatiguing of the friction forces and a compensation for the reduced friction at the loosening moment. It also has the capacity to operate in limited spaces, due to the ratchet spanner design of the torque application arm. As the finishing touch, it has furthermore a torque amplifying effect, which enables also for persons with normal or weak body powers to act with a high torque. The tool is also possible to be given such a design that it in fold-together state occupies a very limited space and may easily replace a conventional ratchet spanner and/or four-way rim wrench in a tool set.

It is obvious for someone skilled in the art that this tool advantageously may be combined with additional functionalities of known art so as to increase the managing of the tool in practise. Accordingly, the axle ends 6*a*, 6*c* are for instance suitably equipped with spring loaded latching balls, as such known in the art, to prohibit the nut socket to slide off the axle end during the use. Likewise, the design of the nut socket may be adjusted in many respects to fit to different types of bolts or nuts. It is also possible to equip the tool with a screwdriver tip and thereby use it to screw and unscrew screws with furrowed heads. In such cases it is, however, normally requested that a force is applied towards the screw so as the tool should not slide out from the groove of the screw head. Other labour operations, where a strong torque in similar ways is needed, may also benefit from the present invention. Another suitable measure at the tool is to design the supporting leg with a telescoping function, e.g. a square tube passed around the arm part, so that the length of the supporting leg easily may be modified and fit to offer resistance against surfaces located at different distances from the nut/bolt. Such modifications are understood as close related for someone skilled in the art and is thereby comprised by the given claims.

Furthermore, the tool may be modified so that the torque arm cap is divided into two parts, which are disposed at each side of the support arm cap, each one with its latching mechanisms at the axle. This has the advantage that the application of torque will take place straight above the supporting leg and not give rise to any torques along the turning axis of the axle 16. In an analogous manner, the support arm cap may comprise two at each side of the torque arm cap located caps to give a corresponding effect.

Figure 6:
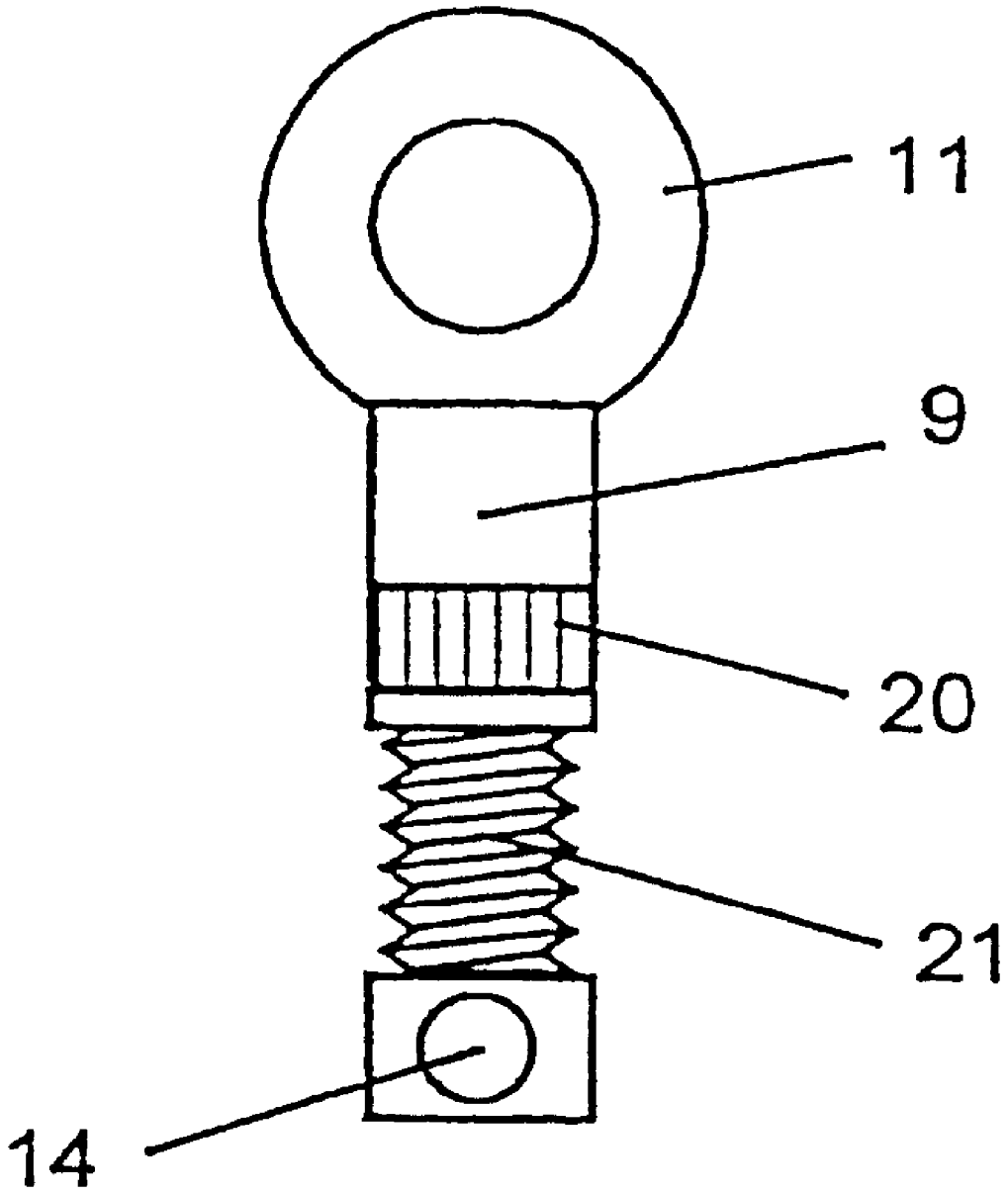
FIG. 6 shows a setting mechanism for the torque amplification.

Another practical variation is a tool according to the earlier described design, where the high torque arm 9 comprises a nut 20 with an internal thread and an adjusting screw 21 (FIG. 6), which makes it possible to change the distance between the turning centre of the axle 6 and the second turning axis 14. This leads according to the above given description that the magnitude of the torque amplification is changed. Such a mechanism for setting the torque amplification may either be used to increase the torque amplification at very firmly fastened bolt, but also to limit the turning torque in cases where a high torque may risk to destroy the nut or bolt. One example of how such a detail may look like, is shown in FIG. 6.

Figure 7:
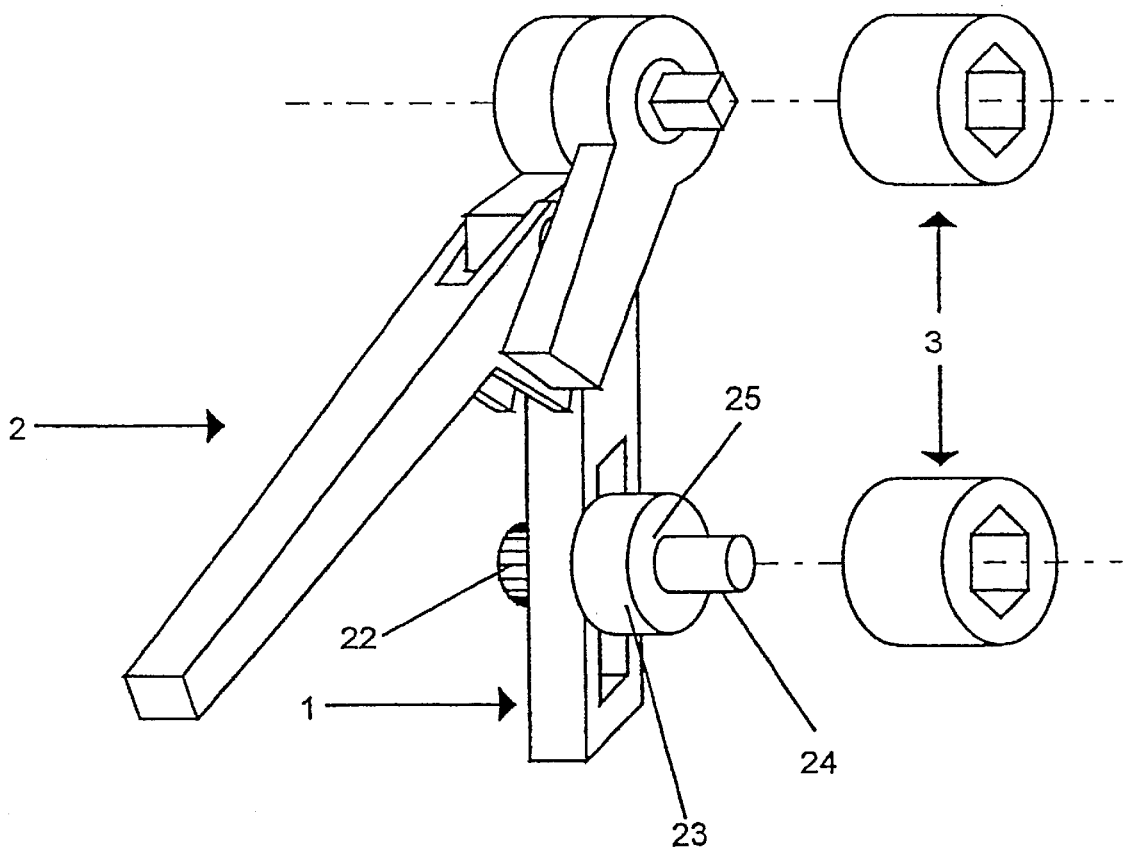
FIG. 7 shows an alternative embodiment of a tool according to the present invention.

A further embodiment of the invention is shown in FIG. 7. This embodiment is intended for loosening of bolts, where there are bolts in the vicinity for support, such as for instance at a vehicle wheel. The arm part 4 of the support arm 1 is adjusted to be able to support on a bolt head situated in the vicinity. A cylinder 23 threaded internally at one end is movable along a groove in the support arm 4 and may be clamped against the support arm 4 at a distance from the axle of the support arm corresponding to the distance between two in the vicinity located bolts by means of a bolt 22 protruding through the groove in the support arm. The other end of the cylinder consists of an end portion with a smaller diameter 24, which portion may be stuck in a socket similar to the socket 3 disposed at the axle 6. The socket 3 is stuck onto the end portion 24 so that the back wall of the socket is butt against a wall 25 of the centre portion of the cylinder, whereby the socket may be rotated around the end portion 24. By adjusting the distance between the sockets 3, these may be disposed around two in the vicinity located bolt heads and the support arm may thereby be supported at one of these bolt heads, when loosening the other.

Figure 5:
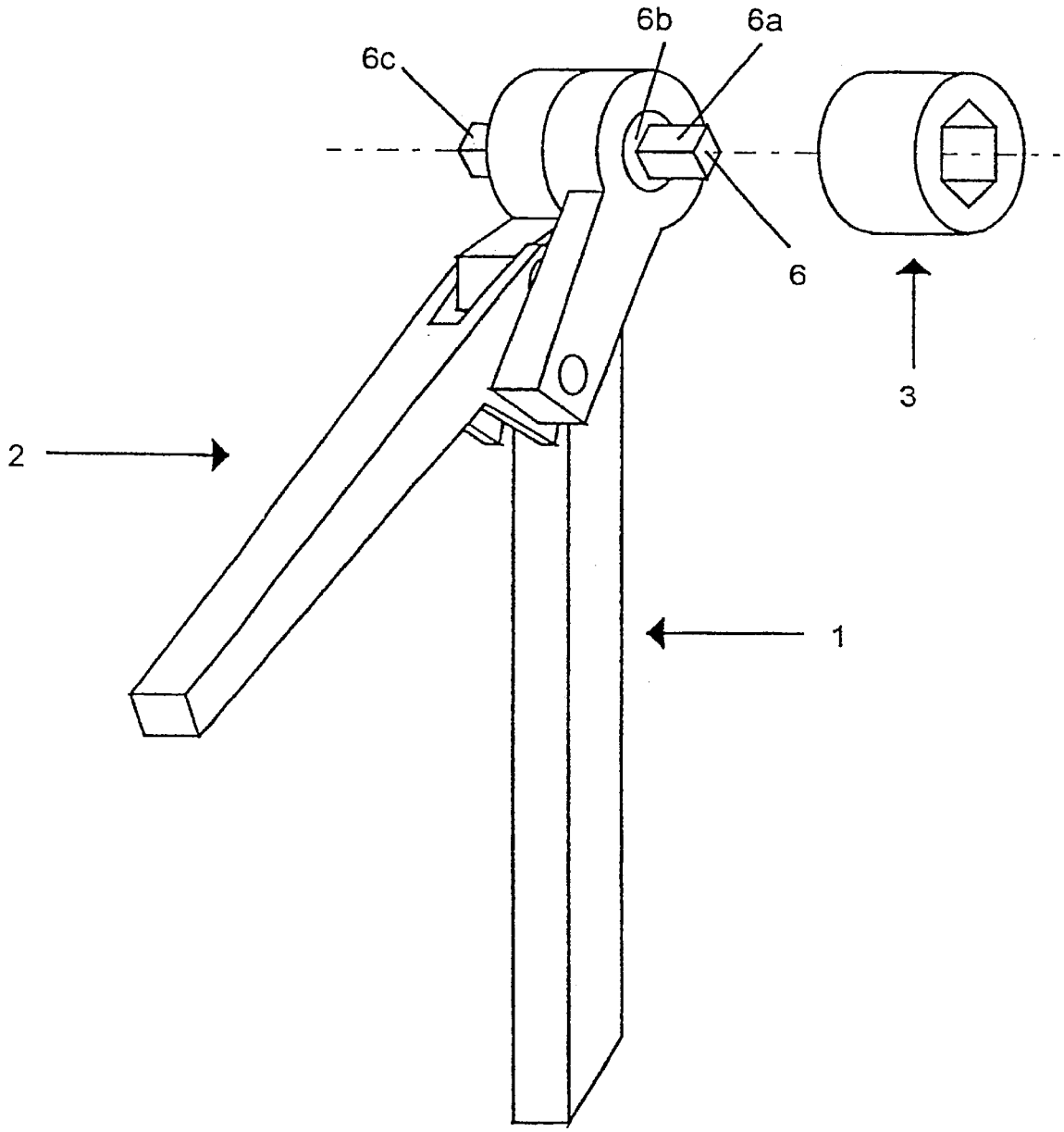
FIG. 5 shows a variation of the tool shown in FIG. 1.

At the use of the tool according to the invention in practise, it is possible that one wants to interrupt an attempt to loosen bolts. In such a situation, the support arm locks the tool from being removed from the bolt. If it is possible to move the object to which the bolt is fastened relative the supporting base, the tool may easily be removed. Another possibility is that the tool comprises disengaging means. A possibility is to let this means abolish the latching itself between the support arm 1 and the axle 6 so that the support arm 1 freely can move around the axle 6. Another possibility is that this disengaging means may be included in the support arm 1 itself, and when necessary aims to change the efficient length of the support arm 1. One way to realise this is to dispose the support arm 1 so as it can be folded, to abolish the latching. The disengaging means may also comprise an, on the support arm 1 arranged, tube portion, which at latching is pulled out and constitutes an action point for the hold-up, but which with a light stroke can be brought to slide along the support arm and thereby reduce its efficient length, whereby the latching consequently ceases. The disengaging means also has to be used if the hand tool, as shown in FIG. 5, is used for fastening of bolts.

It is also obvious that the design of the tool may be varied. The embodiments shown in the figures may further be improved by ergonomical considerations, such as e.g. the design of the gripping surfaces. Furthermore, a tool according to the illustrated embodiments may have problems when supporting against a soft base, since the relatively narrow ends of the arms 1, 2 may sink down in the base. An embodiment with a support plate with a larger area attached to the bottom end of the support arm 1 easily relieves these problems.

It is obvious for someone skilled in the art that the different detail designs may be modified. Latching mechanisms for ratchet spanners are present in different types in known art, and most of these latching methods may preferably be applied to the tool of the invention. In an analogue manner, there are many earlier known torque amplifying constructions, among others those mentioned in the description of known art in this application, which can be implemented instead of the method that in an exemplifying manner is described in connection to FIG. 1 and 5. Such modifications are also understood to fall within the scope of the invention.

What is claimed is:

1. Hand tool for loosening of an attachment means comprising:

a support arm having a rotatable axle;

a torque application arm, arranged around said axle;

at least one socket, connectable to said rotatable axle and formed to receive said attachment means;

a first latching mechanism, arranged between said axle and said torque application arm, preventing rotation of said torque application arm around said axle in a first rotational direction, whereby a torque is transferable in said first rotational direction between said torque application arm and said axle; and a second latching mechanism, acting independently of said first latching mechanism, arranged between said axle and said support arm, preventing rotation of said support arm around said axle in said first rotational direction and allowing rotation of said support arm around said axle in a rotational direction opposite said first rotational direction, whereby said support arm being able to maintain a torque on said axle when said support arm is supported against a supporting base;

wherein said torque application arm comprises a torque amplifying means for the application of said torque at said axle, said torque amplifying means comprises a low torque arm and a high torque arm.

2. Hand tool according to claim 1, wherein said first latching mechanism is arranged between said axle and said torque application arm to allow rotation of said torque application arm around said axle in a direction opposite said first direction, and said torque application arm further comprises means for locking said torque application arm along said axle, said torque application arm being able to present a torque applying action on said axle at motion in said first rotational direction and a torque non applying action at motion in said opposite rotational direction.

3. Hand tool according to claim 1, wherein said low torque arm is turnably arranged to said support arm, around a first turning axis, and said high torque arm is turnably arranged to said low torque arm, around a second turning axis, and whereby said second turning axis is arranged at a longer distance from said axle than said first turning axis.

4. Hand tool according to claim 3, wherein the distance between the turning centre of said axle and the second turning axis is variable, so as to change the torque amplification.

5. Hand tool according to claim 1, wherein said support arm comprises a support means, which is adjustable so as to support against an in-the-vicinity located attachment means.

6. Hand tool according to claim 1, further comprising a disengaging means, enabling abolishing of the latching action of said support arm.

7. Hand tool according to claim 6, wherein said disengaging means is able to abolish said latching between said axle and said support arm.

8. Hand tool according to claim 6, wherein said disengaging means comprises means changing the efficient length of said support arm.

9. Hand tool according to claim 2, wherein said low torque arm is turnably arranged to said support arm, around a first turning axis, and said high torque arm is turnably arranged to said low torque arm, around a second turning axis, and said second turning axis is arranged at a longer distance from said axle than said first turning axis.

10. Hand tool according to claim 9, wherein the distance between the turning centre of said axle and the second turning axis is variable, so as to change the torque amplification.

11. Hand tool according to claim 2, wherein said support arm comprises a support means, which is adjustable so as to support against an in-the-vicinity located attachment means.

12. Hand tool according to claim 3, wherein said support arm comprises a support means, which is adjustable so as to support against an in-the-vicinity located attachment means.

13. Hand tool according to claim 4, wherein said support arm comprises a support means, which is adjustable so as to support against an in-the-vicinity located attachment means.

14. Hand tool according to claim 2, further comprising a disengaging means, enabling abolishing of the latching action of said support arm.

15. Hand tool according to claim 3, further comprising a disengaging means, enabling abolishing of the latching action of said support arm.

* * * * *